US009489833B2

(12) United States Patent
Tanaka et al.

(10) Patent No.: US 9,489,833 B2
(45) Date of Patent: Nov. 8, 2016

(54) REMOTE CONTROL AND COMMUNICATION METHOD FOR REMOTE CONTROL

(71) Applicant: PANASONIC INTELLECTUAL PROPERTY MANAGEMENT CO., LTD., Osaka (JP)

(72) Inventors: Takahiro Tanaka, Osaka (JP); Ayumu Kikuchi, Osaka (JP); Tatsuya Nakahori, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 16 days.

(21) Appl. No.: 14/668,978

(22) Filed: Mar. 25, 2015

(65) Prior Publication Data

US 2015/0199899 A1 Jul. 16, 2015

Related U.S. Application Data

(63) Continuation of application No. PCT/JP2014/004728, filed on Sep. 12, 2014.

(30) Foreign Application Priority Data

Sep. 25, 2013 (JP) ..... 2013-198704

(51) Int. Cl.
*G08C 17/02* (2006.01)
*G08C 23/04* (2006.01)

(52) U.S. Cl.
CPC ..... *G08C 17/02* (2013.01); *G08C 23/04* (2013.01); *G08C 2201/31* (2013.01)

(58) Field of Classification Search
CPC ... G08C 17/02; G08C 23/04; G08C 2201/31
See application file for complete search history.

(56) References Cited

U.S. PATENT DOCUMENTS 8,634,031 B2 1/2014 Ikeda
8,867,918 B2 10/2014 Nakamura
(Continued)

FOREIGN PATENT DOCUMENTS

JP 2010-010886 A 1/2010
JP 2012-508502 A 4/2012
(Continued)

OTHER PUBLICATIONS

International Search Report issued in International Application No. PCT/JP2014/004728 with Date of mailing Nov. 25, 2014.

*Primary Examiner* — Nabil Syed
(74) *Attorney, Agent, or Firm* — McDermott Will & Emery LLP

(57) ABSTRACT

A remote control for controlling a controllable device, including: an infrared transmitter that transmits information via infrared light; a wireless transceiver that transmits information by wireless communication via radio waves; a receiver that receives, from a user, control information to be transmitted to the controllable device; a wireless communication determination unit configured to determine whether wireless communication between the wireless transceiver and the controllable device is possible; and a control unit configured to select, based on a result of the determination by the wireless communication determination unit, one of the infrared transmitter and the wireless transceiver for transmission of the control information to the controllable device, and cause the selected one of the infrared transmitter and the wireless transceiver to transmit the control information to the controllable device.

7 Claims, 10 Drawing Sheets

(56) References Cited

U.S. PATENT DOCUMENTS

| | | | |
|---|---|---|---|
| 8,879,005 | B2 | 11/2014 | Ikeda |
| 2010/0008673 | A1 | 1/2010 | Nakamura |
| 2010/0118209 | A1 | 5/2010 | Hardacker |
| 2012/0327309 | A1 | 12/2012 | Ikeda |
| 2014/0092315 | A1 | 4/2014 | Ikeda |

FOREIGN PATENT DOCUMENTS

| | | | |
|---|---|---|---|
| JP | 2013-009174 | A | 1/2013 |
| WO | 2010/056279 | A2 | 5/2010 |

REMOTE CONTROL AND COMMUNICATION METHOD FOR REMOTE CONTROL

CROSS REFERENCE TO RELATED APPLICATIONS

This is a continuation application of PCT International Application No. PCT/JP2014/004728 filed on Sep. 12, 2014, designating the United States of America, which is based on and claims priority of Japanese Patent Application No. 2013-198704 filed on Sep. 25, 2013. The entire disclosures of the above-identified applications, including the specifications, drawings and claims are incorporated herein by reference in their entirety.

FIELD

The present disclosure is related to remote controls and communication methods for remote controls.

BACKGROUND

Japanese Unexamined Patent Application Publication (Translation of PCT Application) No. 2012-508502 (Patent Literature 1) discloses a remote control system and method capable of automatically selecting between infrared transmission and wireless transmission. The disclosed method includes receiving an input command for communication with a device to be controlled and determining a use context based on the input command. Communication using an infrared transmitter and a radio frequency transmitter is controlled based on the context determination. This allows for selection of the transmission method based on the input command.

SUMMARY

The present disclosure provides a remote control and a communication method for a remote control that reduce the burden of selecting a means of communication.

According to one aspect of the present disclosure, a remote control for controlling a controllable device includes: an infrared transmitter that transmits information via infrared light; a wireless transceiver that transmits information by wireless communication via radio waves; a receiver that receives, from a user, control information to be transmitted to the controllable device; a wireless communication determination unit configured to determine whether wireless communication between the wireless transceiver and the controllable device is possible; and a control unit configured to select, based on a result of the determination by the wireless communication determination unit, one of the infrared transmitter and the wireless transceiver for transmission of the control information to the controllable device, and cause the selected one of the infrared transmitter and the wireless transceiver to transmit the control information to the controllable device.

BRIEF DESCRIPTION OF DRAWINGS

These and other objects, advantages and features of the invention will become apparent from the following description thereof taken in conjunction with the accompanying drawings that illustrate a specific embodiment of the present invention.

DESCRIPTION OF EMBODIMENTS

Figure 1:
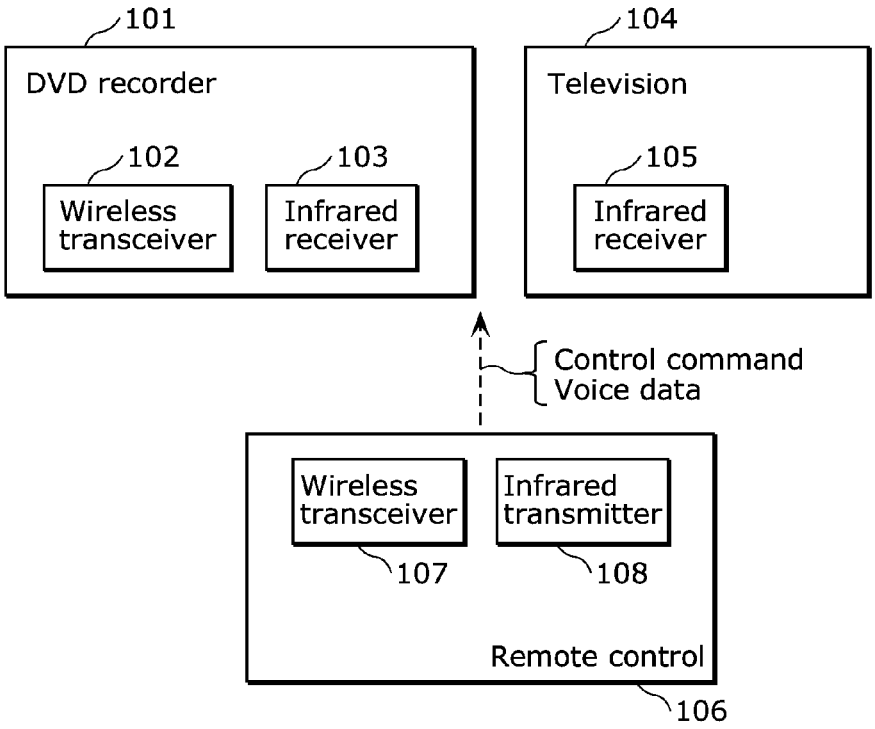
FIG. 1 illustrates a configuration of a remote operation system including the remote control according to Embodiment 1.

Hereinafter, illustrative embodiments will be described in detail with reference to the accompanying Drawings. Note that unnecessarily detailed descriptions may be omitted. For example, detailed descriptions of well-known matters or descriptions of components that are substantially the same as components described previous thereto may be omitted. This is to avoid redundancy and provide easy to read descriptions for those skilled in the art.

Note that the inventors are providing the accompanying Drawings and the following description so that those skilled in the art can sufficiently comprehend the present disclosure. Consequently, the accompanying Drawings and the following description are not intended to limit the subject matter recited in the appended Claims.

(Remote Operation of Devices with a Conventional Remote Control)

First, remote operation of devices with a conventional remote control will be described. Audio/visual devices such as televisions and DVD recorders are generally capable of being remotely operated by a remote control.

One remote control is typically used to operate a single device capable of being remotely operated (hereinafter also referred to as a controllable device). However, some remote controls are used to remotely operate two or more controllable devices. More specifically, remote controls which include buttons for remotely operating a DVD recorder and buttons for remotely operating a television are known.

Infrared light is widely used as a means of communication between the remote control and the controllable device. Recently, remote controls which use near-field communication in addition to infrared light communication have come into use.

Wireless communication remote controls that use an omni-directional means of communication are beneficial in that communication is possible regardless of the orientation of the remote control and possible even if an obstruction is present between the remote control and the controllable device.

Many remote controls that use infrared light communication only transmit a simple, relatively small-sized control code such as a command to resume or pause playback (hereinafter also referred to as a control command or control information) due to the slow transmission speed associated with infrared light communication. In contrast, remote controls that use wireless communication are capable of transmitting a large amount of data compared to a simple command, such as voice data (hereinafter also referred to as voice information).

However, transmitting and receiving data via wireless communication is not suitable for controllable devices, which are in continuous standby for data. This is because transmitting and receiving data via wireless communication consumes more power than transmitting and receiving data via infrared light communication, and the processing load for receiving a large amount of a data is high.

The remote control system disclosed in Patent Literature 1 is capable of selecting a means of communication based on the input made, but not capable of making as election based on the state of the controllable device. In order to control the controllable device regardless of the state of the controllable device, the remote control therefore requires two means of communication for the transmission of data: wireless communication and infrared light communication. When the remote control is capable of transmitting data via these two means of communication, the user must select which of these communication methods to use depending on the state of the controllable device. This complicates the operation of the remote control, making remote control cumbersome to use.

In view of this, the present disclosure provides a remote control and a communication method for a remote control that reduce the burden of selecting a means of communication. In other words, the present disclosure provides a remote control and a communication method for a remote control that select the appropriate means of communication for the state of the controllable device, without requiring the user to select which to use.

According to one aspect of the present disclosure, a remote control for controlling a controllable device includes: an infrared transmitter that transmits information via infrared light; a wireless transceiver that transmits information by wireless communication via radio waves; a receiver that receives, from a user, control information to be transmitted to the controllable device; a wireless communication determination unit configured to determine whether wireless communication between the wireless transceiver and the controllable device is possible; and a control unit configured to select, based on a result of the determination by the wireless communication determination unit, one of the infrared transmitter and the wireless transceiver for transmission of the control information to the controllable device, and cause the selected one of the infrared transmitter and the wireless transceiver to transmit the control information to the controllable device.

With this, the remote control selects whether to use infrared light or wireless communication to transmit the control information to the controllable device, based on whether wireless communication with the controllable device is possible. Here, the user is not required to determine whether wireless communication between the remote control and the controllable device is possible. This eliminates the need for the user to select between infrared and wireless communication. The remote control can therefore reduce the burden placed on the user of selecting a means of communication.

Moreover, the control unit may be configured to: (i) select the wireless transceiver when the wireless communication determination unit determines that wireless communication between the wireless transceiver and the controllable device is possible; and (ii) select the infrared transmitter when the wireless communication determination unit determines that wireless communication between the wireless transceiver and the controllable device is not possible.

With this, the remote control transmits information to the controllable device via wireless communication when wireless communication with the controllable device is possible, and transmits information via infrared light communication when wireless communication with the controllable device is not possible. This allows the remote control to select an appropriate means of communication according to whether wireless communication with the controllable device is possible.

Moreover, the receiver may further receive, from the user, voice information to be transmitted to the controllable device, and the control unit is further configured to cause the wireless transceiver to transmit the voice information to the controllable device when the receiver receives the voice information.

With this, when the data to be transmitted to the controllable device is voice data, the remote control transmits the voice data via wireless communication. Since voice data is large in size compared to a control command and data can be transferred at high speeds via wireless communication, wireless communication is appropriate for transmitting the voice data. In other words, the remote control can select an appropriate means of communication according to the type of information to be transmitted.

Moreover, the wireless communication determination unit may be configured to: (i) determine that wireless communication between the wireless transceiver and the controllable device is possible when the controllable device includes a wireless communication function; and (ii) determine that wireless communication between the wireless transceiver and the controllable device is not possible when the controllable device does not include the wireless communication function.

With this, when the controllable device to which information is to be transmitted is not capable of wireless communication, the remote control transmits information to the controllable device via infrared light communication. This allows the remote control to select an appropriate means of communication according to whether wireless communication with the controllable device to which information is to be transmitted is possible.

Moreover, the control unit may further be configured to cause the wireless transceiver to attempt to establish a wireless connection with the controllable device, and the wireless communication determination unit may be configured to: (i) determine that wireless communication between the wireless transceiver and the controllable device is possible when the wireless transceiver has successfully established the wireless connection with the controllable device; and (ii) determine that wireless communication between the wireless transceiver and the controllable device is not possible when the wireless transceiver has failed to establish the wireless connection with the controllable device.

With this, the remote control attempts to establish a connection with the controllable device via wireless communication, and determines that wireless communication with the controllable device is possible when the connection is successfully established. This allows for ostensive verification of the possibility of wireless communication.

Moreover, the remote control may further include a data storage unit. The control unit may be configured to cause the wireless transceiver to establish or confirm establishment of a wireless connection with the controllable device, and store connection information indicating whether the wireless connection is established or not in the data storage unit, and the wireless communication determination unit may be configured to determine whether wireless communication between the wireless transceiver and the controllable device is possible based on the connection information stored in the data storage unit.

This allows the remote control to reduce the amount of time before the control command can be transmitted to the controllable device. In the case that connection is not established via wireless communication, the remote control must inquire about the connection state of the controllable device, which takes a given amount of time to complete. Removing the need to inquire about the connection state of the controllable device reduces the amount of time before the control command can be transmitted to the controllable device.

Moreover, the control unit may be configured to cause the infrared transmitter to transmit an ON command to the controllable device when the receiver receives the voice information and the wireless communication determination unit determines that wireless communication between the wireless transceiver and the controllable device is not possible, the ON command being a control command for starting wireless communication with the controllable device.

With this, the remote control uses infrared light communication to transmit a control command for placing a controllable device that is in a state in which wireless communication is not established, in a state in which wireless communication is possible. With this, the remote control causes the controllable device to transition to a state in which wireless communication is possible, and then communicates with the controllable device. This allows the remote control to transmit information via wireless communication even to a controllable device that is in a state in which wireless communication is not established.

According to one aspect of the present disclosure, a communication method for a remote control used to control a controllable device, the remote control including an infrared transmitter that transmits information via infrared light and a wireless transceiver that transmits information by wireless communication via radio waves, includes: receiving, from a user, control information to be transmitted to the controllable device; determining whether wireless communication between the wireless transceiver and the controllable device is possible; and selecting, based on a result of the determining, one of the infrared transmitter and the wireless transceiver for transmission of the control information to the controllable device, and causing the selected one of the infrared transmitter and the wireless transceiver to transmit the control information to the controllable device.

This achieves the same advantageous effects as the above remote control.

Embodiment 1

A remote control that is for controlling a controllable device and reduce the burden placed on the user of selecting a means of communication, and a communication method for the remote control, will be discussed in Embodiment 1.

More specifically, the remote control according to the present disclosure includes a wireless transceiver capable of wireless communication, which is more convenient, and an infrared transmitter capable of infrared light communication, which is more energy efficient, and appropriately selects one of the above means of communication based on the configuration or state of the controllable device and performs communication using the selected means of communication. This makes it possible to achieve a system that is both energy efficient and simplifies use of the remote control for the user.

FIG. 1 illustrates a configuration of a remote operation system including the remote control according to Embodiment 1. The remote operation system in FIG. 1 includes a DVD recorder 101, a television 104, and the remote control 106.

The DVD recorder 101 includes a wireless transceiver 102 and an infrared receiver 103. The DVD recorder 101 is a first example of a device that receives information transmitted from the remote control 106 (in other words, a first example of the controllable device).

The wireless transceiver 102 receives control commands or voice data from the remote control 106 via wireless communication.

The infrared receiver 103 receives control commands from the remote control 106 via infrared light communication.

The DVD recorder 101 also includes a standby mode for reducing power consumption that activates only some functions. When in standby mode, the infrared receiver 103 is activated, but the wireless transceiver 102 is not.

The television 104 includes an infrared receiver 105. Television 104 is a second example of a device that receives information transmitted from the remote control 106.

The infrared receiver 105 includes the same function as the infrared receiver 103 in the DVD recorder 101.

The remote control 106 includes a wireless transceiver 107 and an infrared transmitter 108. The remote control 106 is capable of transmitting information or control commands to both the DVD recorder 101 and the television 104.

The remote control 106 and the DVD recorder 101 are capable of performing two-way communication via the wireless transceivers 107 and 102.

The remote control 106 uses the infrared transmitter 108 to communicate with the infrared receiver 103 of the DVD recorder 101 or the infrared receiver 105 of the television 104 via infrared light.

Note that in Embodiment 1, examples of the controllable device include, but are not limited to, the DVD recorder 101 and the television 104.

(Remote Control Configuration)

Figure 2:
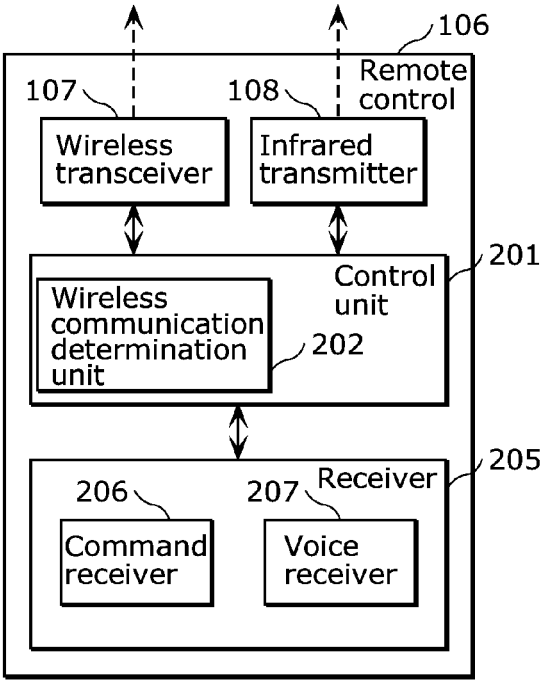
FIG. 2 is a block diagram illustrating a configuration of the remote control according to Embodiment 1.

FIG. 2 is a block diagram illustrating a configuration of the remote control 106.

As illustrated in FIG. 2, the remote control 106 includes a receiver 205, a control unit 201, the wireless transceiver 107, and the infrared transmitter 108.

The receiver 205 receives, from the user, control commands or voice input to be transmitted to the controllable device. The receiver 205 includes a command receiver 206 and a voice receiver 207.

The command receiver 206 receives an input by a user corresponding to a control command for controlling the controllable device.

The command receiver 206 is, for example, a button or touch pad, and receives an input made by the user, such as a press of a button or a slide gesture made on the touch pad. The command receiver 206 then interprets a control command corresponding to the type of button pressed the type of gesture made on the touch pad as a control command for controlling the controllable device. For example, when the play button (not shown in the Drawings) is pressed on the remote control 106, the command receiver 206 interprets this as a control command for starting playback on the DVD recorder 101.

The voice receiver 207 receives a voice input. The voice receiver 207 is, for example, a microphone. When the user speaks into the voice receiver 207, the voice receiver 207 receives this voice input and generates corresponding voice data.

The generated voice data is transmitted as-is to the controllable device. More specifically, the remote control 106 transmits the generated voice data to the controllable device. The controllable device analyzes the voice data and uses the result of the analysis. For example, when the voice receiver 207 receives the voice input "play", voice data corresponding to the received voice input is transmitted to the controllable device. The controllable device then deduces that the voice data includes the "play" by analyzing the voice data, and interprets this as a command to start playback.

The control unit 201 causes the wireless transceiver 107 or the infrared transmitter 108 to transmit a control command or data to the DVD recorder 101 or the television 104 based on the user input obtained from the receiver 205 (in other words, the command receiver 206 or the voice receiver 207) and the state of the wireless connection with the DVD recorder 101 obtained from the wireless transceiver 107.

The control unit 201 includes a wireless communication determination unit 202.

The wireless communication determination unit 202 determines whether wireless communication between the wireless transceiver 102 and the controllable device is possible. The determination method is described in detail later.

The infrared transmitter 108 transmits control commands to the DVD recorder 101 or the television 104.

The wireless transceiver 107 establishes or disconnects wireless connection with the DVD recorder 101, transmits control commands and voice data to the DVD recorder 101. Here, wireless communication via radio waves is used, not infrared light. The wireless transceiver 107 may, for example, use near-field wireless communication such as Bluetooth™. The wireless transceiver 107 may also use a wireless local area network conforming to IEEE802.11a, IEEE802.11b, or IEEE802.11g, etc., and may also use ZigBee.

Figure 3:
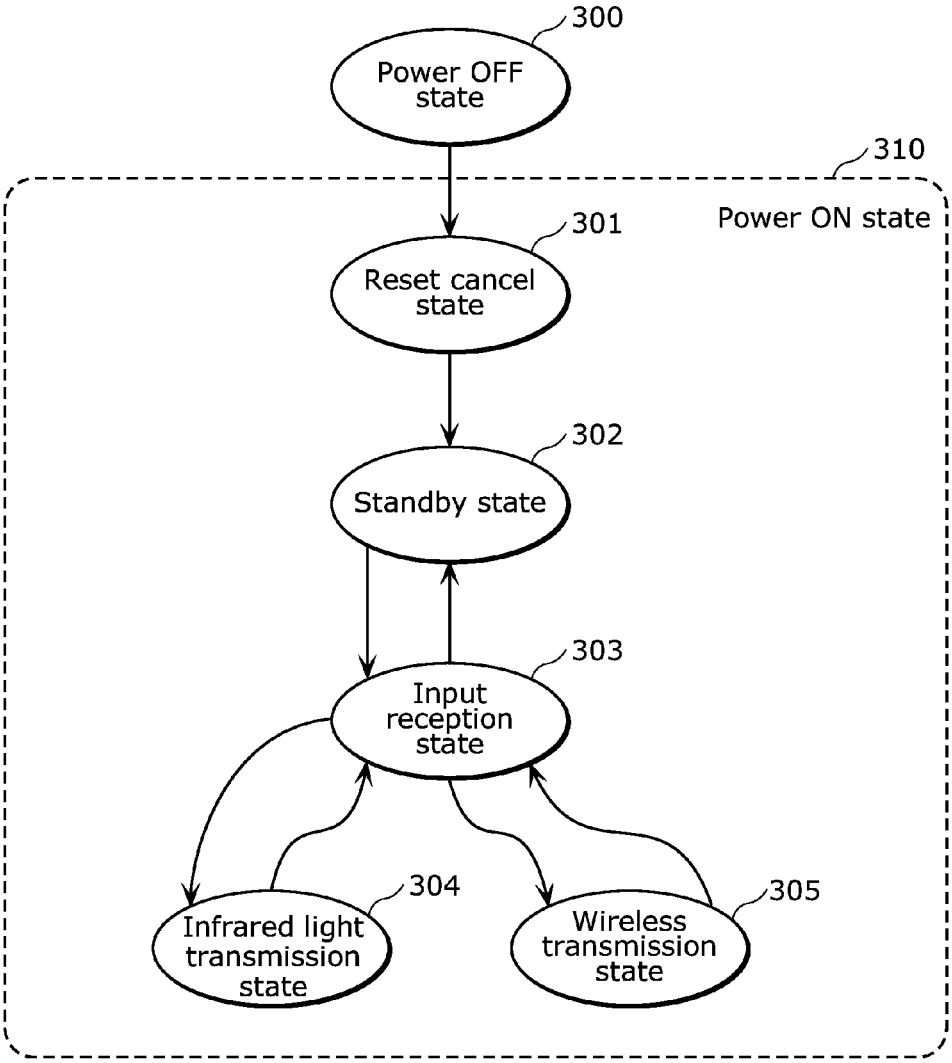
FIG. 3 illustrates transitions between internal states in the remote control according to Embodiment 1.

FIG. 3 illustrates transitions between internal states in the remote control 106.

First, the remote control 106 is in a power OFF state 300.

Upon switching the power on, the remote control 106 transitions to a power ON state 310. The power ON state 310 includes multiples states, including a reset cancel state 301, as illustrated in FIG. 3. These states will be described in detail later.

When the power is turned ON while the remote control 106 is in the power OFF state 300, the remote control 106 transitions to the reset cancel state 301. Initialization of, for example, the control unit 201 and the receiver 205, is performed in the reset cancel state 301. When the initialization is complete, the remote control 106 transitions to a standby state 302.

In the standby state 302, the wireless transceiver 107, the infrared transmitter 108, and the control unit 201 operate in an energy saving state. The standby state 302 is a state which reduces the power consumption of the remote control 106 as a whole. When the command receiver 206 receives an input from the user while the remote control 106 is in the standby state 302, the remote control 106 transitions to an input reception state 303.

In the input reception state 303, the control unit 201 receives the information received by the command receiver 206 or the voice receiver 207, determines to which controllable device the information is to be sent, and determines operation instructions for the controllable device.

Next, when a control command is transmitted to the controllable device via infrared light communication, the remote control 106 transitions to an infrared light transmission state 304. When the remote control 106 is in the infrared light transmission state 304, the remote control 106 transitions to the input reception state 303 after the transmission of the control command is complete.

However, when a control command or voice data is transmitted to the controllable device via wireless communication, the remote control 106 transitions to a wireless transmission state 305. When the remote control 106 is in the wireless transmission state 305, the remote control 106 transitions to the input reception state 303 after the transmission of the control command or voice data is complete.

The infrared light transmission state 304 and the wireless transmission state 305 can only be transitioned to from the input reception state 303, so the remote control 106 is not capable of infrared light transmission or wireless transmission when in the standby state 302.

(Remote Control Internal Operations)

Figure 4:
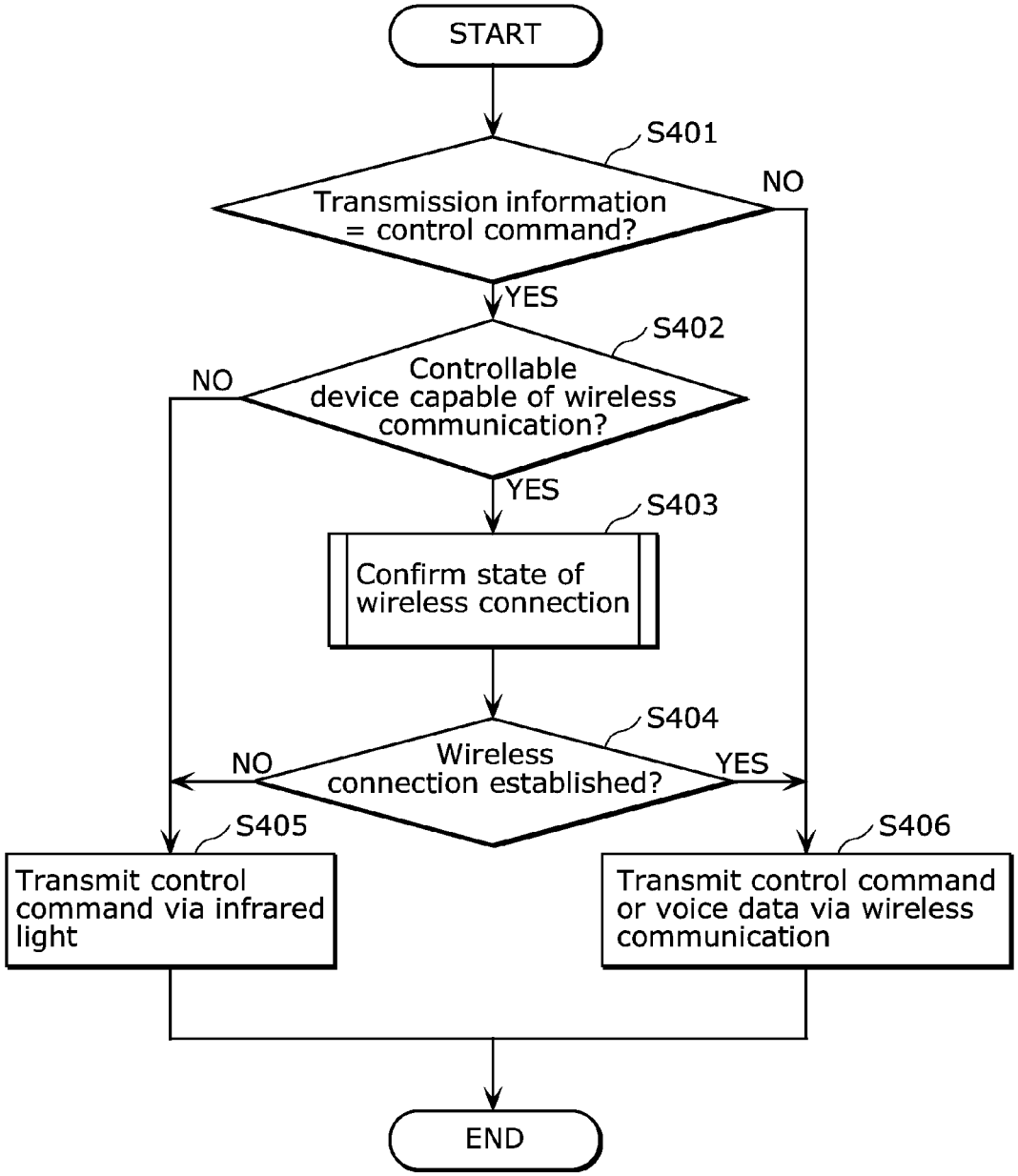
FIG. 4 is a flow chart illustrating operations performed by the remote control according to Embodiment 1 when the remote control receives information.

FIG. 4 is a flow chart illustrating operations performed by the remote control according to Embodiment 1 when the remote control receives information. Operations of the remote control 106 when the command receiver 206 or the voice receiver 207 detects an input of information will be described in detail with reference to FIG. 4.

When the command receiver 206 or the voice receiver 207 detects an input of information, the receiver 205 determines whether what was transmitted as a result of the input was a control command or voice data (step S401). For example, the receiver 205 determines all inputs from the voice receiver 207 to be transmission of voice data. Since voice data is larger in size than a control command, voice data is not transmitted via infrared light communication (NO in step S401), but transmitted to the controllable device via wireless communication in step S406.

When what is transmitted is a control command, the receiver 205 determines which controllable device to transmit the control command to, and determines whether the determined controllable device includes a function for performing wireless communication or not (step S402).

More specifically, when what is transmitted is a control command for the DVD recorder 101, the receiver 205 determines the controllable device to be the DVD recorder 101. The receiver 205 then determines whether the DVD recorder 101, which is the controllable device, includes a function for performing wireless communication or not.

However, when what is transmitted is a control command for the television 104, the receiver 205 determines the controllable device to be the television 104. The receiver 205 then determines whether the television 104, which is the controllable device, includes a function for performing wireless communication or not.

When the controllable device does not include a function for performing wireless communication (NO in step S402), the infrared transmitter 108 transmits the control command via infrared light communication (step S405).

When the controllable device does include a function for performing wireless communication (YES in step S402), the wireless transceiver 107 obtains the state of wireless communication with the controllable device (step S403), and determines whether wireless connection is established or not (step S404).

When wireless connection is established (YES in step S404), the wireless transceiver 107 transmits the control command via wireless communication (step S406).

When the wireless connection is disconnected (NO in S404), the infrared transmitter 108 transmits the control command via infrared light communication (step S405).

Figure 5:
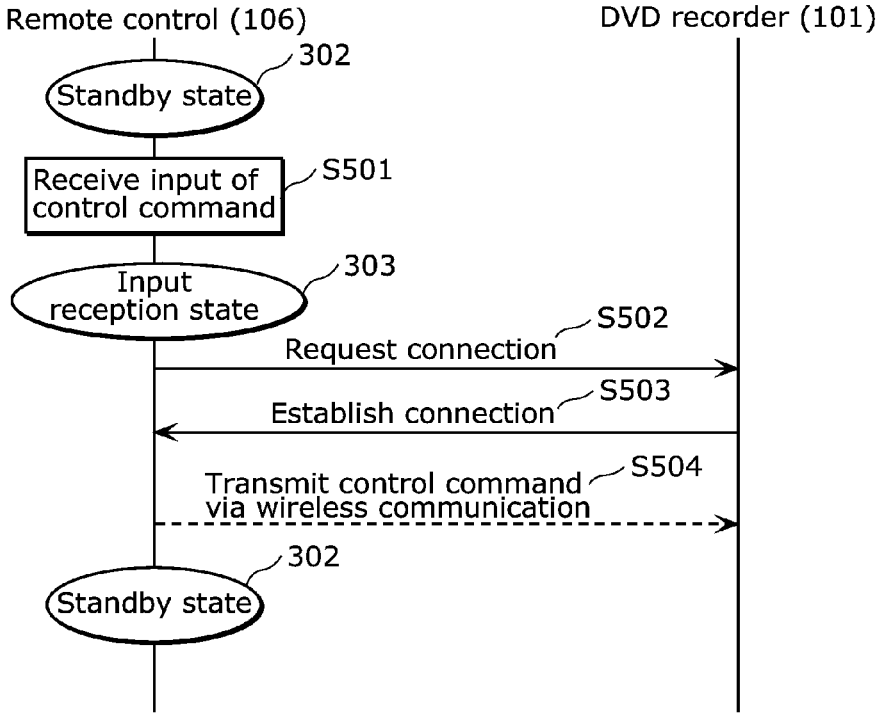
FIG. 5 is a sequence diagram illustrating communication between the remote control according to Embodiment 1 and the controllable device when the remote control receives information.

FIG. 5 is a sequence diagram illustrating communication between the remote control according to Embodiment 1 and the controllable device when the remote control receives information. The flow of processes in steps S403, S404, and S406, from the obtainment of the wireless connection state to the transmission of the control command via wireless communication, will be described in detail with reference to FIG. 5.

The remote control 106 is normally in the standby state 302, which reduces power consumption. When the remote control 106 is in the standby state 302 and the command receiver 206 detects a user input (step S501), the remote control 106 transitions to the input reception state 303, in which input detection and transmission of control commands and data are possible.

The wireless communication determination unit 202 of the control unit 201 analyzes the input from the command receiver 206, and when the wireless communication determination unit 202 determines transmission via wireless communication, the wireless transceiver 107 determines whether a wireless connection with the DVD recorder 101 is established or not.

More specifically, the wireless transceiver 107 transmits a wireless connection request to the DVD recorder 101 (step S502). When the DVD recorder 101 can respond to the transmitted connection request, wireless communication between the wireless transceiver 107 and the DVD recorder 101 is established. When wireless communication is established, a message is transmitted from the DVD recorder 101 to the remote control 106 indicating that a wireless connection is established (step S503). The wireless communication determination unit 202 determines that a wireless connection with the DVD recorder 101 is established based on receipt of the message indicating the establishment of the wireless connection.

By the control unit 201 receiving the message indicating the establishment of a connection with the DVD recorder 101, the control unit 201 determines that a wireless connection is established, and causes the wireless transceiver 107 to transmit the control command via wireless communication (step S504).

When the transmission of the control command is complete, the control unit 201 transitions to the standby state 302 to reduce power consumption.

Figure 6:
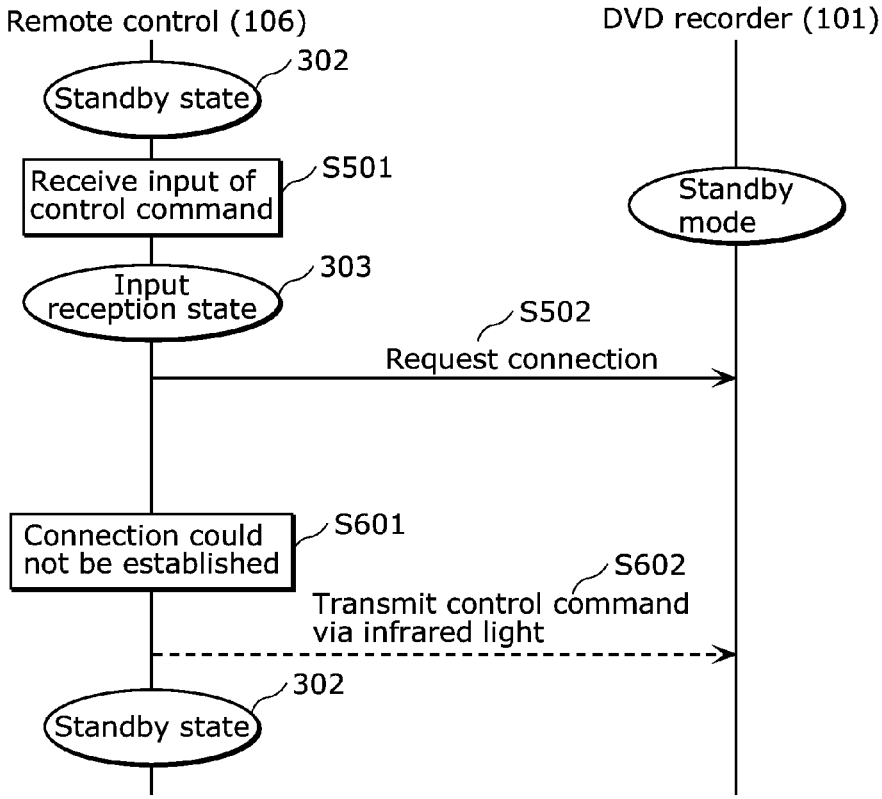
FIG. 6 is a sequence diagram illustrating communication between the remote control according to Embodiment 1 and the controllable device when the controllable device is in an energy saving state and the remote control receives information.

FIG. 6 is a sequence diagram illustrating communication between the remote control according to Embodiment 1 and the controllable device in the energy saving state when the remote control receives information. The flow of sequential processes in steps S403, S404, and S405 when the wireless connection is disconnected will be described in detail with reference to FIG. 6.

When the remote control 106 is in the standby state 302 and the command receiver 206 detects a user input (step S501), the remote control 106 transitions to the input reception state 303, analyzes the input, and transmits a control command.

When the wireless communication determination unit 202 of the control unit 201 determines to transmit the control command to the DVD recorder 101 via wireless communication, the wireless transceiver 107 determines whether a wireless connection with the DVD recorder 101 is established or not.

When the DVD recorder 101 is in a state in which wireless communication is not possible, the wireless transceiver 107 cannot confirm whether a wireless connection with the DVD recorder 101 is established or not. A state in which wireless communication is not possible is, for example, when the DVD recorder 101 is in standby mode that reduces power consumption by turning off functions related to wireless communication.

More specifically, as described above, the wireless transceiver 107 transmits a wireless connection request to the DVD recorder 101 (step S502). When the DVD recorder 101 cannot respond to the transmitted connection request, wireless communication between the wireless transceiver 107 and the DVD recorder 101 is not established (step S601). When the wireless transceiver 107 does not confirm the establishment of a wireless connection after a predetermined period of time has elapsed in response to the transmitted connection request, the wireless communication determination unit 202 determines that a wireless connection with the DVD recorder 101 cannot be used, and transmits the control command via infrared light communication (step S602).

When the transmission of the control command is complete, the control unit 201 transitions to the standby state 302 to reduce power consumption.

Advantageous Effect

In the case that a voice input is received, the remote control according to Embodiment 1 selects wireless communication and transfers the voice data to the controllable device. This makes it possible to appropriately select a means of communication among infrared light communication and wireless communication via radio waves, even without express instruction from the user.

Embodiment 2

In Embodiment 2, a remote control will be discussed which stores information indicating the wireless connection state, and communicates with the controllable device in a short amount of time using the stored information.

Figure 7:
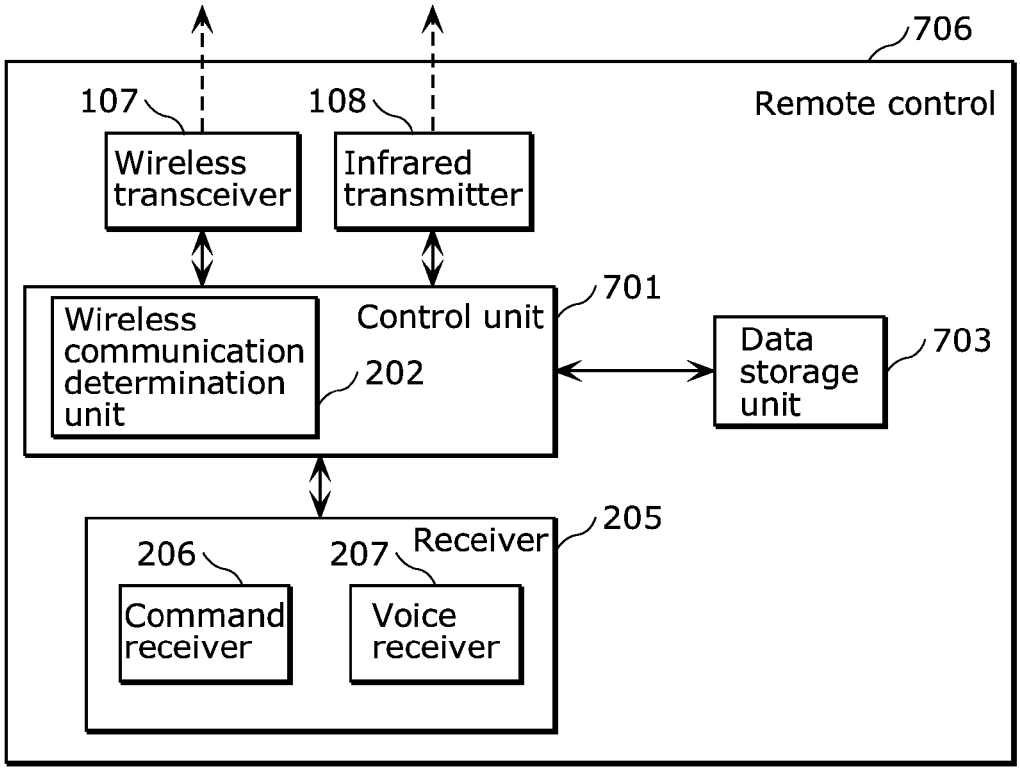
FIG. 7 is a block diagram illustrating a configuration of the remote control according to Embodiment 2.

FIG. 7 is a block diagram illustrating a configuration of the remote control 706 according to Embodiment 2.

As illustrated in FIG. 7, in addition to the configuration of the remote control 106 according to Embodiment 1, the remote control 706 according to Embodiment 2 includes a data storage unit 703.

Based on the user input received by the command receiver 206 or the voice receiver 207 and the wireless connection state with the DVD recorder 101 stored in the data storage unit 703, the control unit 701 causes the wireless transceiver 107 or the infrared transmitter 108 to transmit a control command or data to the DVD recorder 101 or the television 104.

Similar to Embodiment 1, the remote control 706 includes the internal states illustrated in FIG. 3 in Embodiment 2 as well.

Figure 8:
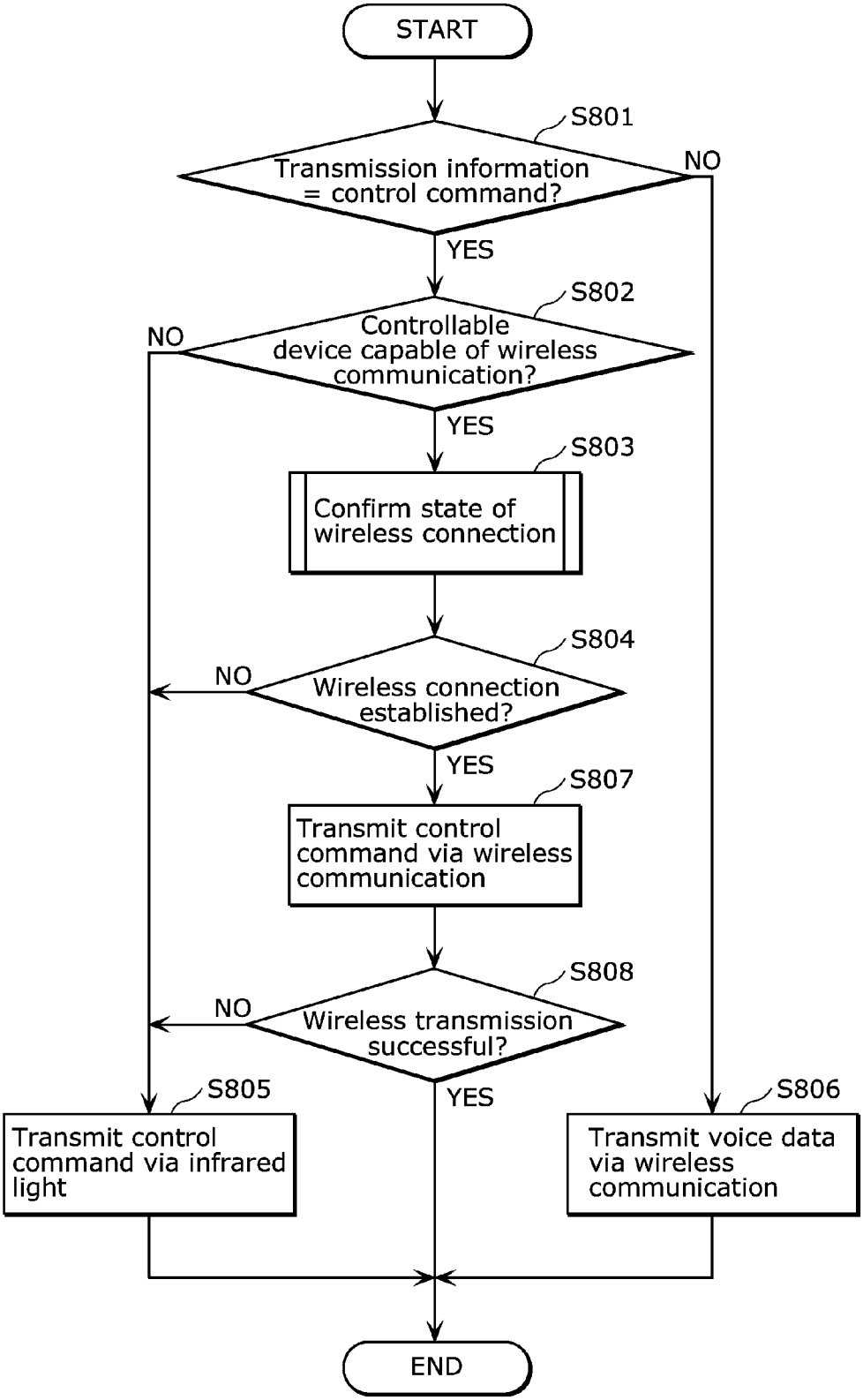
FIG. 8 is a flow chart illustrating operations performed by the remote control according to Embodiment 2 when the remote control receives information.

FIG. 8 is a flow chart illustrating operations performed by the remote control 706 when the remote control detects an input from an input unit 203 and an input unit 204.

When the command receiver 206 or the voice receiver 207 detects an input of information from the user, the receiver 205 determines whether what was transmitted as a result of the input was a control command or voice data (step S801). For example, the receiver 205 determines all inputs from the voice receiver 207 to be transmission of voice data. In this case, the input data is transmitted to the controllable device via wireless communication (step S806).

When what is transmitted is a control command, the receiver 205 selects which controllable device to transmit the control command to, and determines whether the selected controllable device includes a function for performing wireless communication or not (step S802).

When the controllable device does not include a function for performing wireless communication (NO in step S802), the control unit 701 causes the infrared transmitter 108 to transmit the control command via infrared light communication (step S805).

When the controllable device does include a function for performing wireless communication (YES in step S802), the control unit 701 obtains information indicating the state of wireless communication with the controllable device stored in advance in the data storage unit 703 (step S803), and determines whether a wireless connection is established or not (step S804).

When a wireless connection is established between the wireless transceiver 107 and the controllable device (YES in step S804), the control unit 701 causes the wireless transceiver 107 to transmit the control command via wireless communication (step S807).

However, when a wireless connection is not established between the wireless transceiver 107 and the controllable device (NO in step S804), the control unit 701 causes the infrared transmitter 108 to transmit the control command via infrared light communication (step S805).

When obtaining the state of the wireless connection in advance, even when the wireless connection state indicates that a wireless connection is established, it is possible that the wireless connection will be disconnected when the control command is transmitted via wireless communication. For this reason, after the transmission is completed in step S807, a step S808 may be performed which confirms the success or failure of the transmission of information via wireless communication. In this case, when wireless transmission fails (NO in step S808), the same control command is retransmitted via infrared light communication (step S805).

Figure 9:
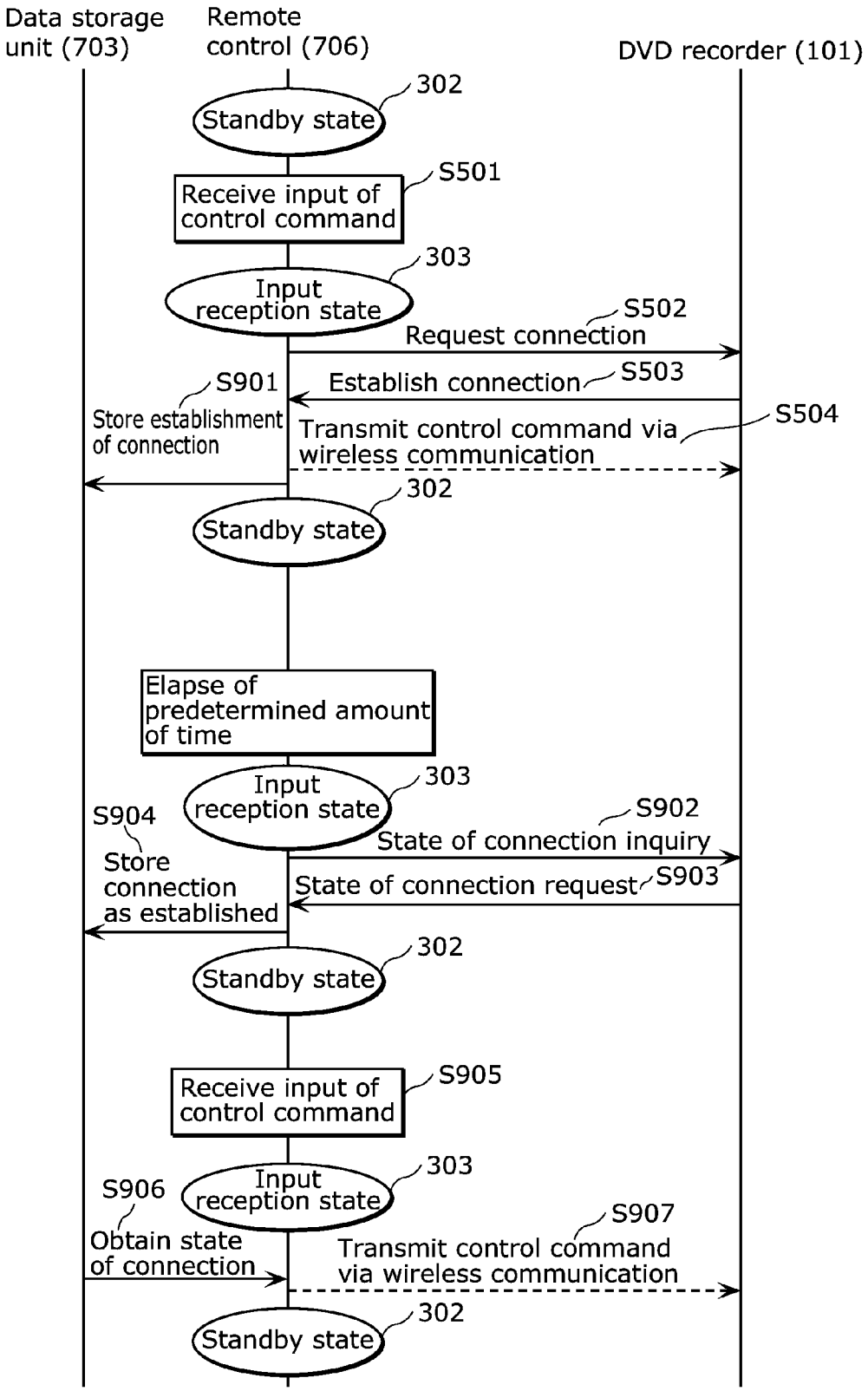
FIG. 9 is a sequence diagram illustrating communication between the remote control according to Embodiment 2 and the controllable device when the remote control receives information.

FIG. 9 is a sequence diagram illustrating communication between the remote control according to Embodiment 2 and the controllable device when the remote control receives information. The flow of sequential processes performed when a control command is transmitted via wireless communication using the advance confirmation of the wireless connection state of the remote control 706 and the DVD recorder 101 and the stored wireless connection state will be described with reference to FIG. 9.

Similar to the remote control 106 according to Embodiment 1, when the 706 receives an input corresponding to a control command from the user, the remote control 706 transmits the control command via wireless communication after a wireless connection has been established (steps S501 to S504).

After the remote control 706 transmits the control command via wireless communication in step S504, the control unit 701 saves information in the data storage unit 703 indicating that the wireless connection is successfully established (step S901). The remote control 706 then transitions to the standby state 302.

When the remote control 706 is in the standby state 302 for longer than a predetermined amount of time, the remote control 706 transitions to the input reception state 303, and confirms whether a wireless connection with the DVD recorder 101, which is the controllable device, is established or not (steps S902 and S903). Note that the predetermined amount of time may be, for example, approximately 10 msec.

When it is confirmed that the wireless connection is established in steps S902 and S903, the control unit 701 saves information in the data storage unit 703 indicating that the wireless connection is successfully established (step S904). The remote control 706 then transitions to the standby state 302.

The above processes are performed in a predetermined time interval, and the most current connection state with the DVD recorder 101 is stored in the data storage unit 703.

When an input from the command receiver 206 is detected (step S905), the remote control 706 transitions from the standby state 302 to the input reception state 303. In the input reception state 303, the control unit 701 obtains information indicating whether a wireless connection with the DVD recorder 101 is established or not from the data storage unit 703 (step S906), and if a wireless connection is established, causes the wireless transceiver 107 to transmit a control command to the DVD recorder 101 via wireless communication (step S907).

Figure 10:
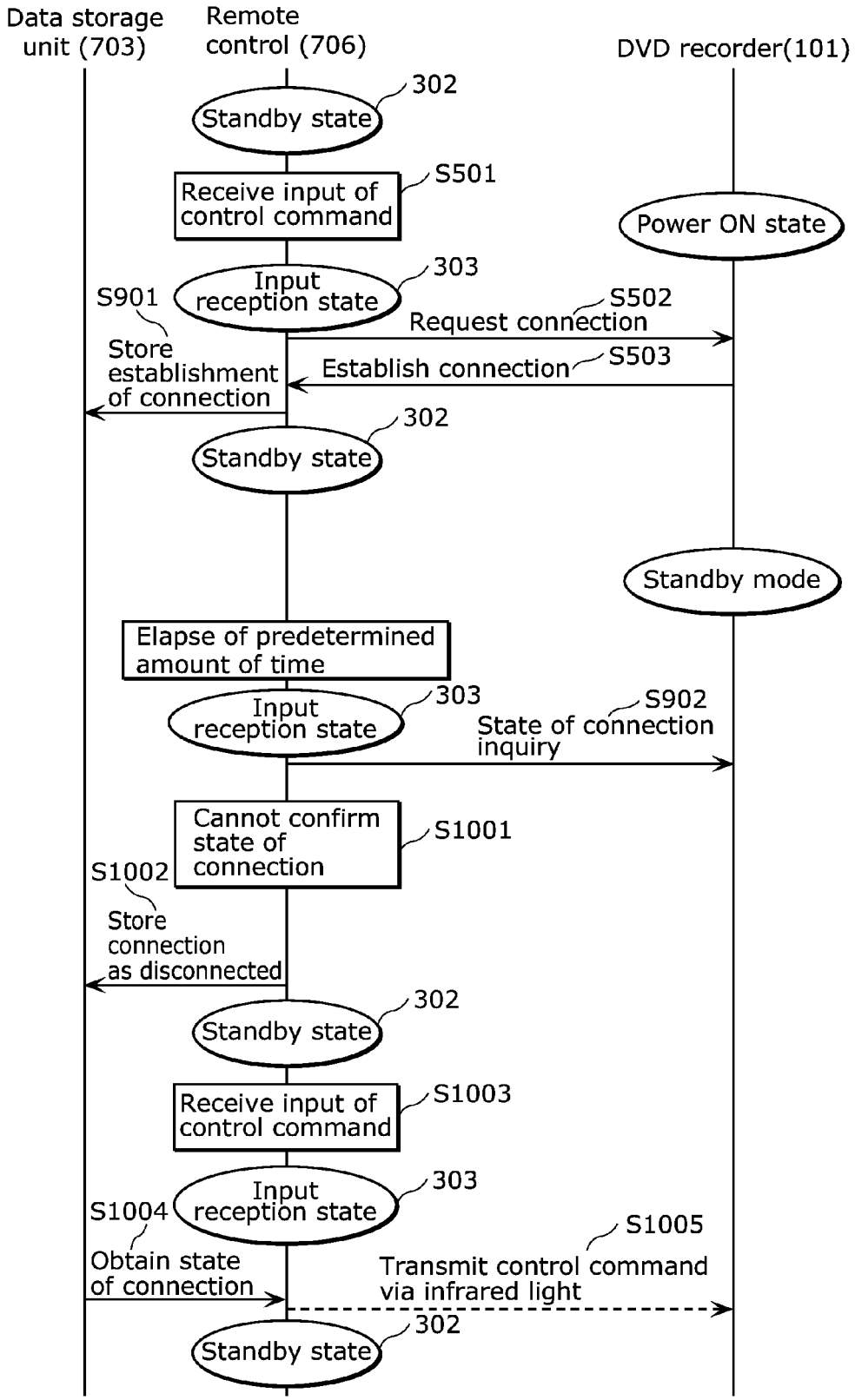
FIG. 10 is a sequence diagram illustrating communication between the remote control according to Embodiment 2 and the controllable device when the remote control receives information.

FIG. 10 illustrates the processing flow when a control command is transmitted via infrared light communication as a result of a wireless connection not being established.

Similar to FIG. 9, the remote control 706 checks the wireless connection state with the DVD recorder 101 at predetermined intervals, and stores the most recent state in the data storage unit 703.

When it cannot be confirmed that a wireless connection is established within the predetermined interval upon checking the wireless connection (step S1001), the wireless connection is determined to be not established (for example, disconnected), and the control unit 701 stores information indicating such in the data storage unit 703 (step S1002).

When an input of a control command from the command receiver 206 is detected (step S1003), the remote control 706 transitions from the standby state 302 to the input reception state 303. The control unit 701 obtains information indicating whether a wireless connection with the DVD recorder 101 is established or not from the data storage unit 703 (step S1004). In step S1002 above, since information indicating that a wireless connection is not established is stored in the data storage unit 703, the control unit 701 obtains information indicating that a wireless connection is not established in step S1004. When a wireless connection is not established, the control unit 701 causes the infrared transmitter 108 to transmit a control command to the DVD recorder 101 via infrared light communication (step S1005).

Note that an input of a control command is received by the receiver 206 in step S1003, but in the case that the input is received after a predetermined amount of time has elapsed from when the wireless connection could not be confirmed in step S1001, the remote control 706 may perform processing for establishing a wireless connection again (steps S501 to S504). This is because the wireless connection may be reestablished after a predetermined amount of time has elapsed after the wireless connection cannot be confirmed.

With the above operations, even when the input unit 203 detects a same input by the user, the remote control 706 can select an appropriate means of communication based on the state of the DVD recorder 101 and cause the wireless transceiver 107 or the infrared transmitter 108 to transmit a control command to the controllable device.

Advantageous Effect

As described above, in Embodiment 2, even when there is no input from the input unit 203 and the input unit 204, the remote control 706 stores the most recent state of communication with the DVD recorder 101, which is the controllable device, in the data storage unit 703. With this, even when the state of the DVD recorder 101 changes due to a reason unrelated to the control command from the remote control 706, resulting in transition from a state in which wireless communication is possible to a state in which wireless communication is not possible, the remote control 706 can know the state of the DVD recorder 101 and the control unit 701 can appropriately select a means of communication.

In Embodiment 2, when the command receiver 206 receives an input of a control command, information obtained from the data storage unit 703 is used to determine whether or not wireless connection is established (step S906 and step S1004) without inquiring about the state of the wireless connection. In the case that a connection is not established via wireless communication, the remote control must inquire about the connection state of the controllable device, which takes a given amount of time to complete. Removing the need to inquire about the connection state of the controllable device reduces the amount of time before the control command can be transmitted to the controllable device.

Embodiment 3

Embodiment 3 describes a remote control that communicates with a controllable device by transmitting a control command for placing a controllable device that is in a state in which wireless communication is not established, in a state in which wireless communication is possible, using infrared light communication.

Note that the DVD recorder 101 can enter a second standby mode in addition to the standby mode described in Embodiment 1. When in the second standby mode, the wireless transceiver 102 and the infrared receiver 103 are both activated. In Embodiment 3, the standby mode described in Embodiment 1 is referred to as the first standby mode.

Hereinafter, Embodiment 3 will be described with reference to FIG. 7, FIG. 11, and FIG. 12.

The remote control according to Embodiment 3 has the same configuration as in Embodiment 2, which is illustrated in FIG. 7.

Figure 11:
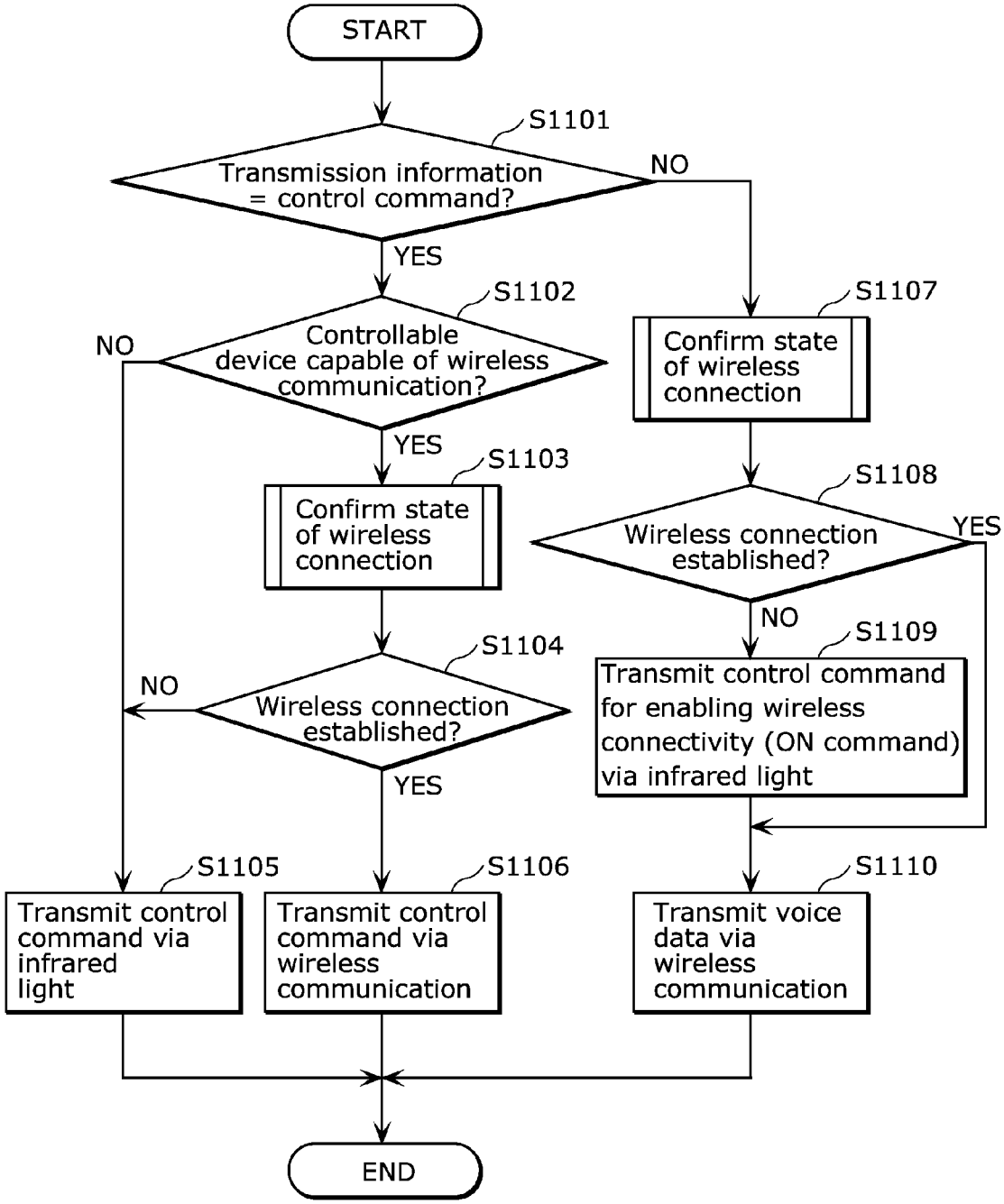
FIG. 11 is a flow chart illustrating operations performed by the remote control according to Embodiment 3 when the remote control receives information.

FIG. 11 is a flow chart illustrating operations performed by the remote control according to Embodiment 3 when the remote control receives information. More specifically, FIG. 11 is a flow chart illustrating operations performed by the remote control 706 when the command receiver 206 or the voice receiver 207 detects a user input.

When the command receiver 206 or the voice receiver 207 detects a user input, the control unit 701 determines whether what was transmitted as a result of the input was a control command or voice data in step S1101.

When what is transmitted is a control command (YES in step S1101), the control unit 701 selects which controllable device to transmit the control command to, and determines whether the selected controllable device includes a function for performing wireless communication or not (step S1102). When the controllable device does not include a function for performing wireless communication (NO in step S1102), the control unit 701 causes the infrared transmitter 108 to transmit the control command via infrared light communication (step S1105).

When the controllable device does include a function for performing wireless communication (YES in step S1102), the control unit 701 obtains information indicating the state of wireless communication with the controllable device stored in advance in the data storage unit 703 (step S1103), and determines whether a wireless connection is established or not (step S1104).

When a wireless connection is established between the wireless transceiver 107 and the controllable device (YES in step S1104), the control unit 701 causes the wireless transceiver 107 to transmit the control command via wireless communication (step S1107). However, when a wireless connection is not established between the wireless transceiver 107 and the controllable device (NO in step S1104), the control unit 701 causes the infrared transmitter 108 to transmit the control command via infrared light communication (step S1105).

When what is to be transmitted is voice data (NO in step S1101), the control unit 701 obtains information on the state of the wireless connection with the controllable device from the data storage unit 703 (step S1107), similar to step S1103.

When a wireless connection is established between the wireless transceiver 107 and the controllable device (YES in step S1108), the control unit 701 causes the wireless transceiver 107 to transmit the received voice data to the controllable device (step S1110).

When a wireless connection is not established between the wireless transceiver 107 and the controllable device (NO in step S1108), the controllable device cannot communicate over a wireless connection. In this case, the control unit 701 causes the infrared transmitter 108 to transmit a control command for enabling wireless connectivity (hereinafter also referred to as an ON command) to the controllable device (step S1109).

Here, when a wireless connection is not established, the controllable device may be in the first standby mode, for example. The purpose of the ON command transmitted in step S1109 is to transition the controllable device into the second standby mode.

When transmission of the ON command is complete, the control unit 701 causes the wireless transceiver 107 to transmit data to the controllable device (step S1110).

Figure 12:
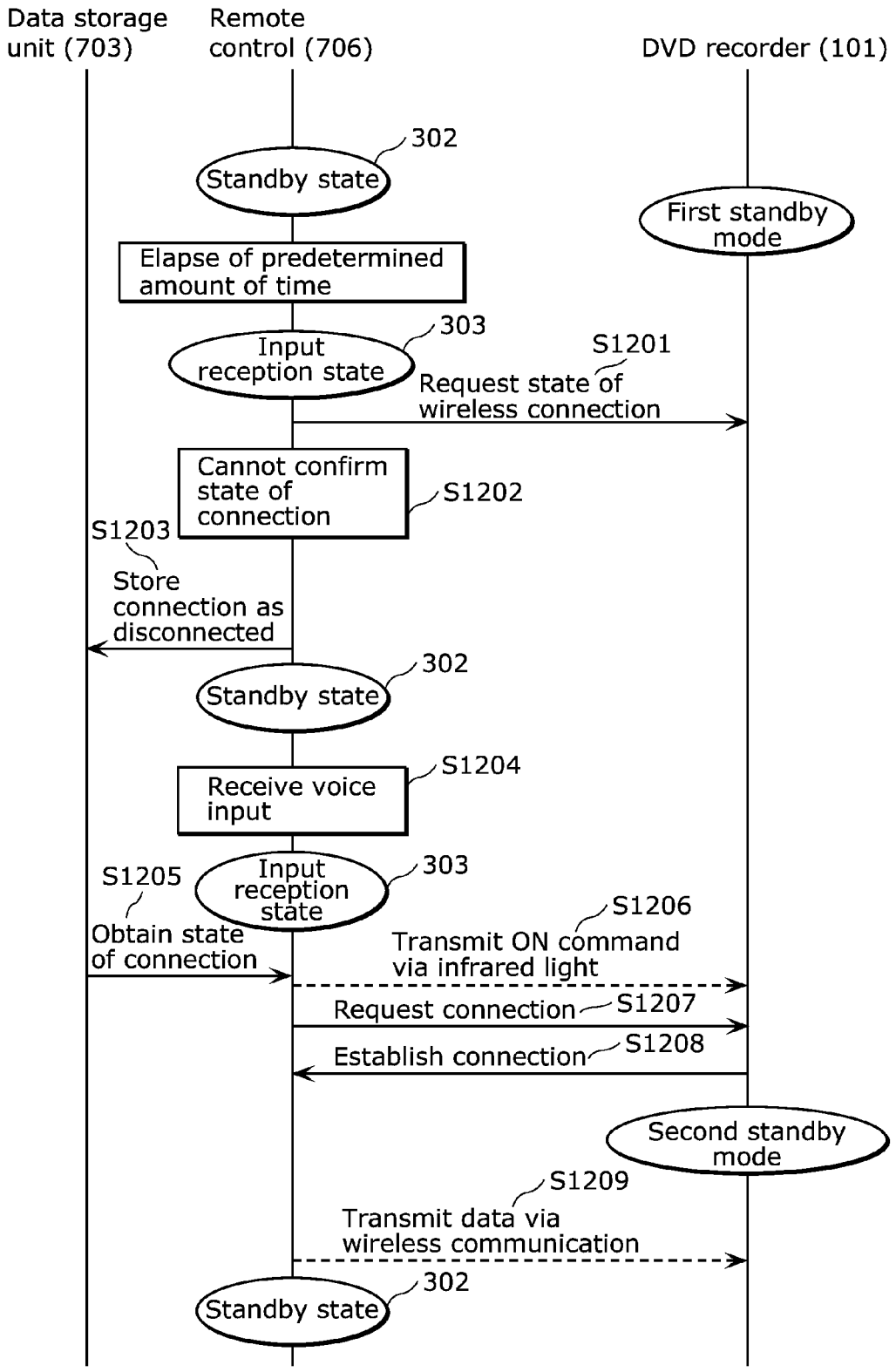
FIG. 12 is a sequence diagram illustrating the process flow when the remote control according to Embodiment 3 receives information and the controllable device is in a state in which wireless communication is not possible.

FIG. 12 is a sequence diagram illustrating the process flow when the remote control according to Embodiment 3 receives information and the controllable device is in a state in which wireless communication is not possible. The process flow when the remote control 706 receives a voice input from the input unit 204 when communication with the remote control 706 is not possible, such as when the DVD recorder 101 is in an energy saving state, will be described with reference to FIG. 12.

The remote control 706 inquires about the state of the wireless connection with the DVD recorder 101 (step S1201) at predetermined intervals, and stores the most recent state regarding whether the connection is established or disconnected in the data storage unit 703.

When a response that the wireless connection is established is not received within a predetermined period of time upon inquiring about the state of the wireless connection (step S1202), the wireless connection is determined to be not established, and the control unit 701 stores information indicating that the wireless connection is not established in the data storage unit 703 (step S1203).

When a voice input from the voice receiver 207 is detected (step S1204), the remote control 706 transitions from the standby state 302 to the input reception state 303. Since inputs from the voice receiver 207 are large in data size, the data is transmitted using only wireless communication.

When the internal state of the remote control 706 transitions to the input reception state 303, the control unit 701 obtains information indicating whether a wireless connection with the DVD recorder 101 is established or not from the data storage unit 703 (step S1205). When a wireless connection is not established, the control unit 701 causes the infrared transmitter 108 to transmit an ON command to the DVD recorder 101 via infrared light communication (step S1206).

When the DVD recorder 101 receives an ON command from the remote control 706 while in the first standby mode, the DVD recorder 101 transitions to the second standby mode in which wireless communication is possible.

Upon completion of transmission of the ON command, the control unit 701 transmits a wireless connection request to the DVD recorder 101 (step S1207), whereby wireless connection is established (step S1208).

After a wireless connection is established, the control unit 701 causes the wireless transceiver 107 to transmit the voice data received from the voice receiver 207 to the DVD recorder 101 (step S1209). Since the DVD recorder 101 transitions to the second standby mode, in which wireless communication is possible, upon receipt of the ON command, the DVD recorder 101 can receive voice data via wireless communication.

Advantageous Effect

As described above, in Embodiment 3, when transmission via wireless communication is required and the DVD recorder 101 is in a state in which it cannot perform wireless communication, the remote control 706 includes a step for using infrared light communication in advance to transmit an instruction to the DVD recorder 101 to allow wireless communication.

With this, the remote control 706 can transmit voice data input from the input unit 204 to the DVD recorder 101, even when the DVD recorder 101 is in a state in which wireless communication is not possible, such as when the DVD recorder 101 is turned off.

Note that the above embodiments are examples of the techniques disclosed in the present disclosure. To this extent, the accompanying drawings and detailed description are provided.

Thus, the components set forth in the accompanying drawings and detailed description include not only components essential to overcome the previously mentioned problems but also components unnecessary to overcome the previously mention problems for the purpose of illustrating the above illustrative embodiments. Those unnecessary components should not be deemed essential due to the mere fact that they are described in the accompanying drawings and the detailed description.

The above embodiments illustrate the techniques of the present disclosure, and thus various modifications, permutations, additions and omissions are possible in the scope of the appended claims and the equivalents thereof.

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

INDUSTRIAL APPLICABILITY

The remote control and the communication method for the remote control disclosed in the present disclosure are applicable in cases where devices, such as household electronics or audio/visual devices such as televisions or DVD recorders, are remotely controlled with a remote control capable of multiple means of communication, such as infrared light communication and wireless communication.

The invention claimed is:

1. A remote control for controlling a controllable device, the remote control comprising:

an infrared transmitter that transmits information via infrared light;

a wireless transceiver that transmits information by wireless communication via radio waves;

a receiver that receives, from a user, control information to be transmitted to the controllable device;

a wireless communication determination unit configured to determine whether wireless communication between the wireless transceiver and the controllable device is possible;

a control unit configured to select, based on a result of the determination by the wireless communication determination unit, one of the infrared transmitter and the wireless transceiver for transmission of the control information to the controllable device, and cause the selected one of the infrared transmitter and the wireless transceiver to transmit the control information to the controllable device; and a data storage unit, wherein the control unit is configured to cause the wireless transceiver to establish or confirm establishment of a wireless connection with the controllable device, and store connection information indicating whether the wireless connection is established or not in the data storage unit, and the wireless communication determination unit is configured to determine whether wireless communication between the wireless transceiver and the controllable device is possible based on the connection information previously stored in the data storage unit on the basis of the control unit causing the wireless transceiver to establish or confirm establishment of the wireless connection with the controllable device.

2. The remote control according to claim 1, wherein the control unit is configured to:

(i) select the wireless transceiver when the wireless communication determination unit determines that wireless communication between the wireless transceiver and the controllable device is possible; and (ii) select the infrared transmitter when the wireless communication determination unit determines that wireless communication between the wireless transceiver and the controllable device is not possible.

3. The remote control according to claim 1, wherein the receiver further receives, from the user, voice information to be transmitted to the controllable device, and the control unit is further configured to cause the wireless transceiver to transmit the voice information to the controllable device when the receiver receives the voice information.

4. The remote control according to claim 1, wherein the wireless communication determination unit is configured to:

(i) determine that wireless communication between the wireless transceiver and the controllable device is possible when the controllable device includes a wireless communication function; and (ii) determine that wireless communication between the wireless transceiver and the controllable device is not possible when the controllable device does not include the wireless communication function.

5. The remote control according to claim 1, wherein the control unit is further configured to cause the wireless transceiver to attempt to establish a wireless connection with the controllable device, and the wireless communication determination unit is configured to:

(i) determine that wireless communication between the wireless transceiver and the controllable device is possible when the wireless transceiver has successfully established the wireless connection with the controllable device; and (ii) determine that wireless communication between the wireless transceiver and the controllable device is not possible when the wireless transceiver has failed to establish the wireless connection with the controllable device.

6. The remote control according to claim 3, wherein the control unit is configured to cause the infrared transmitter to transmit an ON command to the controllable device when the receiver receives the voice information and the wireless communication determination unit determines that wireless communication between the wireless transceiver and the controllable device is not possible, the ON command being a control command for starting wireless communication with the controllable device.

7. A communication method for a remote control used to control a controllable device, the remote control including an infrared transmitter that transmits information via infrared light and a wireless transceiver that transmits information by wireless communication via radio waves, the communication method comprising:

receiving, from a user, control information to be transmitted to the controllable device;

determining whether wireless communication between the wireless transceiver and the controllable device is possible and storing connection information indicating whether wireless communication between the wireless transceiver and the controllable device is possible; and selecting, based on the previously stored connection information, one of the infrared transmitter and the wireless transceiver for transmission of the control information to the controllable device, and causing the selected one of the infrared transmitter and the wireless transceiver to transmit the control information to the controllable device.

* * * * *